US008238798B2

(12) United States Patent
Hatakeyama et al.

(10) Patent No.: US 8,238,798 B2
(45) Date of Patent: Aug. 7, 2012

(54) DEVELOPING DEVICE AND DEVELOPING METHOD FOR IMAGE FORMING APPARATUS

(75) Inventors: Takashi Hatakeyama, Kanagawa (JP); Takao Izumi, Kanagawa (JP); Hiroshi Murata, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 257 days.

(21) Appl. No.: 12/833,177

(22) Filed: Jul. 9, 2010

(65) Prior Publication Data

US 2011/0013945 A1 Jan. 20, 2011

Related U.S. Application Data

(60) Provisional application No. 61/225,768, filed on Jul. 15, 2009.

(51) Int. Cl.
*G03G 15/08* (2006.01)

(52) U.S. Cl. ..... 399/259; 399/258

(58) Field of Classification Search ..... 399/258, 399/259

See application file for complete search history.

(56) References Cited

U.S. PATENT DOCUMENTS

| | | | | |
|---|---|---|---|---|
| 6,405,009 | B1 * | 6/2002 | Shinkawa et al. | 399/253 |
| 7,796,900 | B2 * | 9/2010 | Playfair | 399/27 |
| 2006/0204296 | A1 * | 9/2006 | Maruyama et al. | 399/349 |
| 2010/0232839 | A1 * | 9/2010 | Yamaguchi | 399/254 |

FOREIGN PATENT DOCUMENTS

| | | |
|---|---|---|
| JP | 59-100471 | 6/1984 |
| JP | 09-185177 | 7/1997 |

* cited by examiner

*Primary Examiner* — David Gray
*Assistant Examiner* — Gregory H Curran
(74) *Attorney, Agent, or Firm* — Turocy & Watson, LLP

(57) ABSTRACT

According to an embodiment, a developing device, comprising: a developing unit configured to store an initial two-component developer including an initial toner containing silica externally added and a carrier and to form a toner image on an image bearing member with the two-component developer; a discharging section configured to discharge a part of the initial developer from the developing unit; and a developer supplying unit configured to supply a supply developer including a supply toner containing silica externally added and the carrier to the developing unit, the amount of silica added to the supply toner being smaller than the amount of silica added to the initial toner.

20 Claims, 10 Drawing Sheets

| NUMBER OF PRINTED SHEETS (1000) | ANGLE OF REPOSE | |
|---|---|---|
| | EMBODIMENT 1 | DEVELOPER IN THE PAST |
| 0 | 32. 2° | 32. 2° |
| 20 | 33. 2° | 33. 5° |
| 60 | 34. 0° | 34. 4° |
| 100 | 34. 2° | 34. 6° |

| PERCENTAGE OF TONER WITHOUT SILICA (%) | ANGLE OF REPOSE |
|---|---|
| 0 | 32. 0° |
| 20 | 29. 5° |
| 60 | 28. 8° |
| 100 | 28. 5° |

Fig. 11

| | NUMBER OF PRINTED SHEETS | 0 | 20K | 60K | 100K |
|---|---|---|---|---|---|
| DENSITY UNEVENNESS | EMBODIMENT 1 | ○ | ○ | ○ | ○ |
| | IN THE PAST | ○ | ○ | △ | × |
| SPILL OF DEVELOPER | EMBODIMENT 1 | ○ | ○ | ○ | ○ |
| | IN THE PAST | ○ | ○ | △ | × |

| NUMBER OF PRINTED SHEETS (1000) | ANGLE OF REPOSE | | |
|---|---|---|---|
| | EMBODIMENT 1 | EMBODIMENT 2 | IN THE PAST |
| 0 | 32. 2° | 32. 2° | 32. 2° |
| 20 | 33. 2° | 33. 1° | 33. 5° |
| 60 | 34. 0° | 33. 6° | 34. 4° |
| 100 | 34. 2° | 34. 0° | 34. 6° |

DEVELOPING DEVICE AND DEVELOPING METHOD FOR IMAGE FORMING APPARATUS

CROSS-REFERENCE TO RELATED APPLICATION

The present invention is based upon and claims the benefit of priority from the provisional application (61/225,768) filed Jul. 15, 2009, the entire content of which is incorporated herein by reference.

FIELD

Embodiments described herein relate generally to a developing device and a developing method in an image forming apparatus.

BACKGROUND

In an apparatus employing an electrophotographic technique such as a copying machine, a printer, and a facsimile, a two-component developer including a toner and a carrier for developing an electrostatic latent image on the surface of a photoconductive member is stored in a developing device. The developing device supplies the toner to the surface of the photoconductive member.

In a dry-type two-component developer, the toner is consumed by development of a latent image but the carrier remains in the developing device. A resin coat material on the surface of the carrier peels or a toner component adheres to the surface. Such a carrier deteriorates charging performance of the developer and causes deterioration in an image characteristic.

There is known a configuration for, in order to gradually replace a carrier, storing a developer obtained by mixing a toner and a small amount of the carrier in a developer supply container and supplying the carrier to a developing device together with the toner.

Among image forming apparatuses employing such a configuration, there is an image forming apparatus in which, in order to automatically perform replacement of the two-component developer, a developer overflow section at predetermined height is provided on a downstream side of the developer to be agitated and moved.

Usually, the two-component developer includes a toner and a carrier. When the number of sheets to be printed increases, fluidity of the developer changes and the developer is not smoothly discharged from the developer overflow section. Therefore, the developer is held up more than necessary and is not discharged unless the quantity of the developer substantially increases. As a result, a spill of the developer and development unevenness occur.

Therefore, the present invention provides a developing system and a developing method in which, even if the number of printed sheets increases, the fluidity of a developer does not substantially fall and a spill of the developer and density unevenness do not occur for a relatively long period.

BRIEF DESCRIPTION OF THE DRAWINGS

FIG. 11 is a table of density unevenness and a spill of a developer that occur when the number of printed sheets is increased in the first embodiment, wherein the density unevenness and the spill of the developer are compared with those in the past;

DETAILED DESCRIPTION

An embodiment of a developing device, comprising: a developing unit configured to store an initial two-component developer including an initial toner containing silica externally added and a carrier and to form a toner image on an image bearing member with the two-component developer; a discharging section configured to discharge a part of the initial developer from the developing unit; and a developer supplying unit configured to supply a supply developer including a supply toner containing silica externally added and the carrier to the developing unit, the amount of silica added to the supply toner being smaller than the amount of silica added to the initial toner.

In an embodiment of the present invention, a predetermined amount of silica is contained in an initial toner included in a two-component developer used as an initial developer initially stored in a developing device. An amount of silica of a supply toner included in a two-component developer to be supplied is smaller than the amount of silica contained in the initial toner. The amount of silica contained in the initial toner is 3 wt % to 5 wt % with respect to the entire toner. The amount of silica contained in the supply toner is equal to or smaller than, for example, 0.5 wt % with respect to the entire toner. In the embodiment of the present invention, it is desirable that less silica is contained in the supply toner. A toner without silica to which silica is not externally added is used as the supply toner. The supply toner means a toner used in a supply developer together with a carrier.

A method of manufacturing the initial developer in this embodiment is explained.

The initial developer includes an initial toner and a developer. 4 wt % of carnauba wax as a releasing agent, 5 wt % of carbon black as a colorant, and 1.5% of CCA containing Al and Mg are mixed with polyester resin by using a Henschel mixer, kneaded by an extrusion melting kneader, and ground and classified to form a core toner.

3 wt % of silica and 0.1 wt % of metal soap as a lubricant of a drum cleaner are added to the core toner and mixed by the Henschel mixer for a predetermined time to externally add the silica and the metal soap to the core toner. A ferrite carrier is mixed with such a toner at carrier density of 92 wt % to prepare a developer.

The supply developer is manufactured in the same manner as the method of manufacturing the initial toner. However, an externally added agent not containing silica is used as a toner. The ferrite carrier is mixed with the toner at carrier density of 92 wt % to prepare the supply developer.

Figure 1:
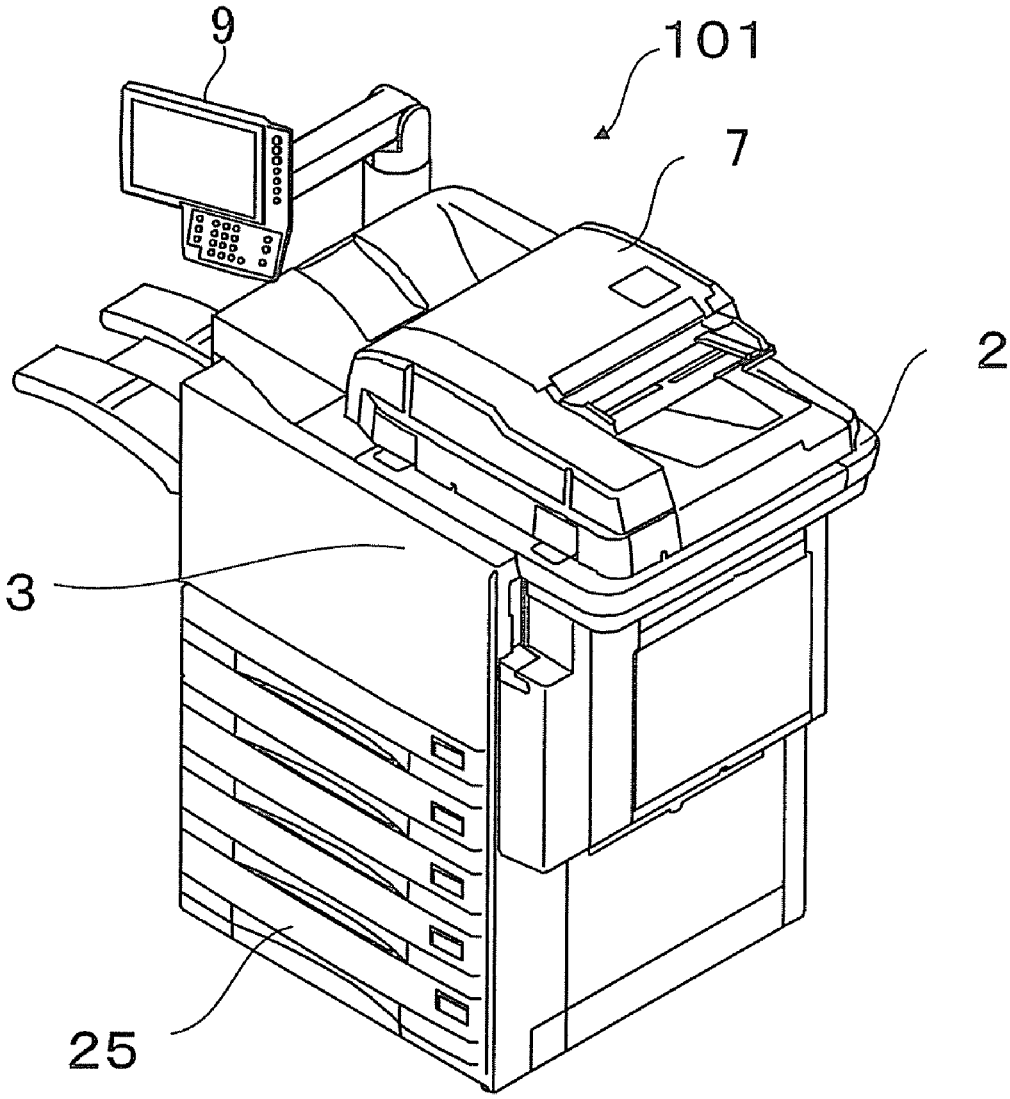
FIG. 1 is a perspective view of an external appearance of an image forming apparatus including a developing device according to an embodiment.
Figure 2:
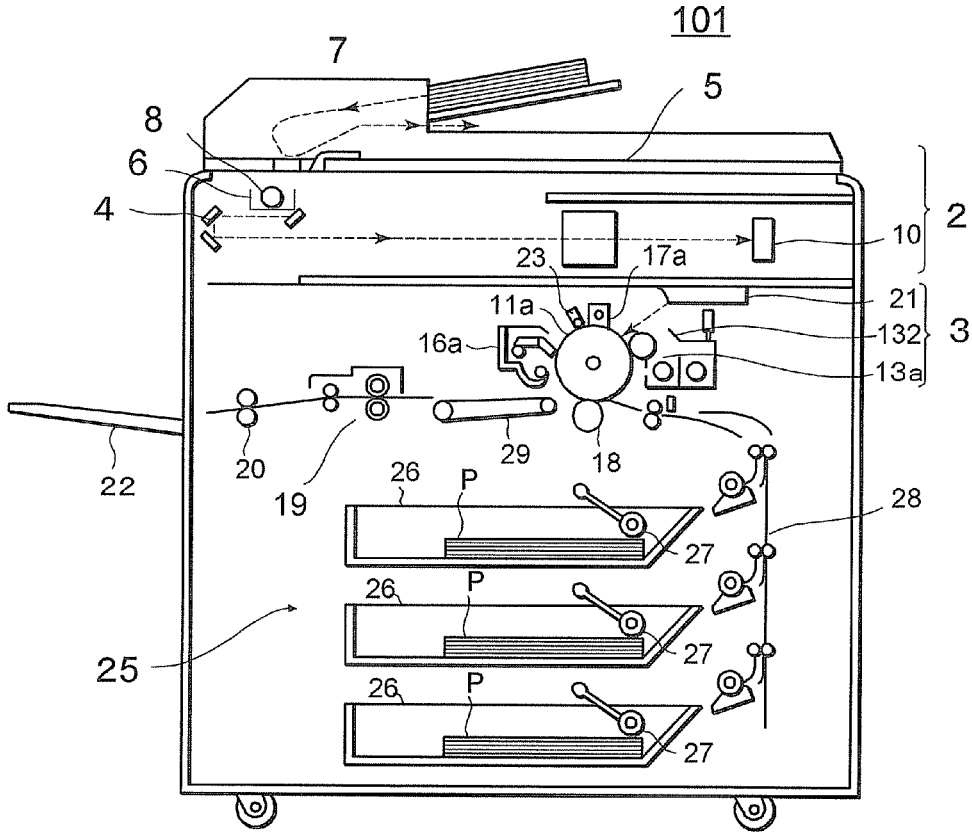
FIG. 2 is a schematic front view of the internal structure of the image forming apparatus shown in FIG. 1.

This embodiment is explained below with reference to the accompanying drawings. An overview of an image forming apparatus 101 according to this embodiment is shown in FIG. 1. The internal structure of the image forming apparatus 101 is shown in FIG. 2. FIG. 1 is a perspective view of an external appearance of the image forming apparatus 101 according to this embodiment. As shown in FIG. 2, the image forming apparatus 101 includes an image reading unit 2 and an image forming unit 3.

The image forming unit 3 outputs image information as an output image called, for example, hard copy or printout. The image reading unit 2 captures, as image data, image information to be subjected to image formation in the image forming unit 3 from an original document on which the image information is held.

An auto document feeder 7 is provided above the image reading unit 2. The auto document feeder 7 has a function of, when an original document is a sheet-like document, after reading of image information in the image reading unit 2 ends, discharging the original document, from which the reading of the image information ends, from a reading position to a discharge position and guiding the next original document to the reading position.

A display unit 9 movable by an arm is provided in an upper part of the image forming apparatus 101 (not shown in FIG. 2). The display unit 9 is an instruction input unit, i.e., a control panel for instructing the start of image formation in the image forming unit 3 and the start for reading image information of an original document by the image reading unit 2.

The configuration of the image forming apparatus 101 is explained with reference to FIG. 2. The image forming apparatus 101 includes the image reading unit 2 configured to read an image and the image forming unit 3 configured to form an image.

The image reading unit 2 includes a transparent document placing table 5, a carriage 6 configured to reciprocatingly move under the document placing table 5, an exposure lamp 8 provided in the carriage 6, a reflection mirror 9, and a CCD (Charge Coupled Device) 10 configured to capture reflected light and convert image information of the light into an electric signal.

The image forming unit 3 includes a drum-like photoconductive drum 11*a*, a laser unit 21 configured to form an electrostatic latent image on the photoconductive drum 11*a*, a charging device 17*a* arranged around the photoconductive drum 11*a*, a developing device 13*a* configured to develop the electrostatic latent image on the photoconductive drum 11*a*, a transfer device 18, and a cleaner 16*a*.

The image forming unit 3 further includes a fixing device 19 configured to fix, with heat and pressure, an image on a sheet P onto which the image is transferred by the transfer device 18 and a paper discharge roller 20 configured to discharge the sheet P having the image fixed thereon to a paper discharge tray 22 as a sheet discharge section.

A paper feeding unit 25 is provided below the image forming unit 3. The paper feeding unit 25 includes plural cassettes 26 in which sheets P of different sizes are stored. The respective cassettes 26 include pickup rollers 27 configured to extract the sheets P one by one. A conveying path 28 conveys the sheet P extracted by the pickup rollers 27 to the transfer device 18.

Actions of image formation are explained below. An exposing mechanism including the carriage 6 and the exposure lamp 8 irradiates light on an original document placed on the document placing table 5. Reflected light from the original document is guided by the reflection mirror 9. A reflected light image is projected on the CCD 10. Image information captured by the CCD 10 is converted into a digital signal after being output as analog information. The digital signal is transmitted to the laser unit 21 after being subjected to image processing.

When the image formation is started, the charging device 17*a* supplies predetermined charges to the outer circumference of the photoconductive drum 11*a* that is charged in a predetermined charging position and rotates. The laser unit 21 irradiates, according to the image information transmitted thereto, a laser beam on the outer circumferential surface of the photoconductive drum 11*a* charged to uniform potential in an axial direction by the charging device 17*a*. According to the irradiation of the laser beam, an electrostatic latent image corresponding to the image information of the original document is formed on the outer circumferential surface of the photoconductive drum 11*a*. A developer is supplied from the developing device 13*a* to the electrostatic latent image on the photoconductive drum 11*a*. The electrostatic latent image is converted into a toner image, i.e., the electrostatic latent image is developed.

As the developer, a two-component developer with a toner carried on a carrier by agitating and mixing the toner and the carrier is used.

A developing roller 132 is rotatably provided in the developing device 13*a*. The developing roller 132 is arranged to be opposed to the photoconductive drum 11*a* and rotates to thereby supply to the toner onto the photoconductive drum 11*a*. When a toner image is formed on the photoconductive drum 11*a*, the transfer device 18 electrostatically transfers the toner image onto the sheet P conveyed from the paper feeding unit 25 by the conveying path 28. A conveyor belt 29 conveys the sheet P having the toner image transferred thereon to the fixing device 19. The fixing device 19 fixes the toner image, which is transferred onto the sheet P, on the sheet P with heat and pressure. The paper discharge roller 20 discharges the sheet P, on which the image formation is completed by the fixing of the toner image, onto the paper discharge tray 22.

The cleaner 16*a* removes the toner remaining on the photoconductive drum 11*a* without being transferred. A charge removing device 23 removes residual charges on the photoconductive drum 11*a*.

Figure 3:
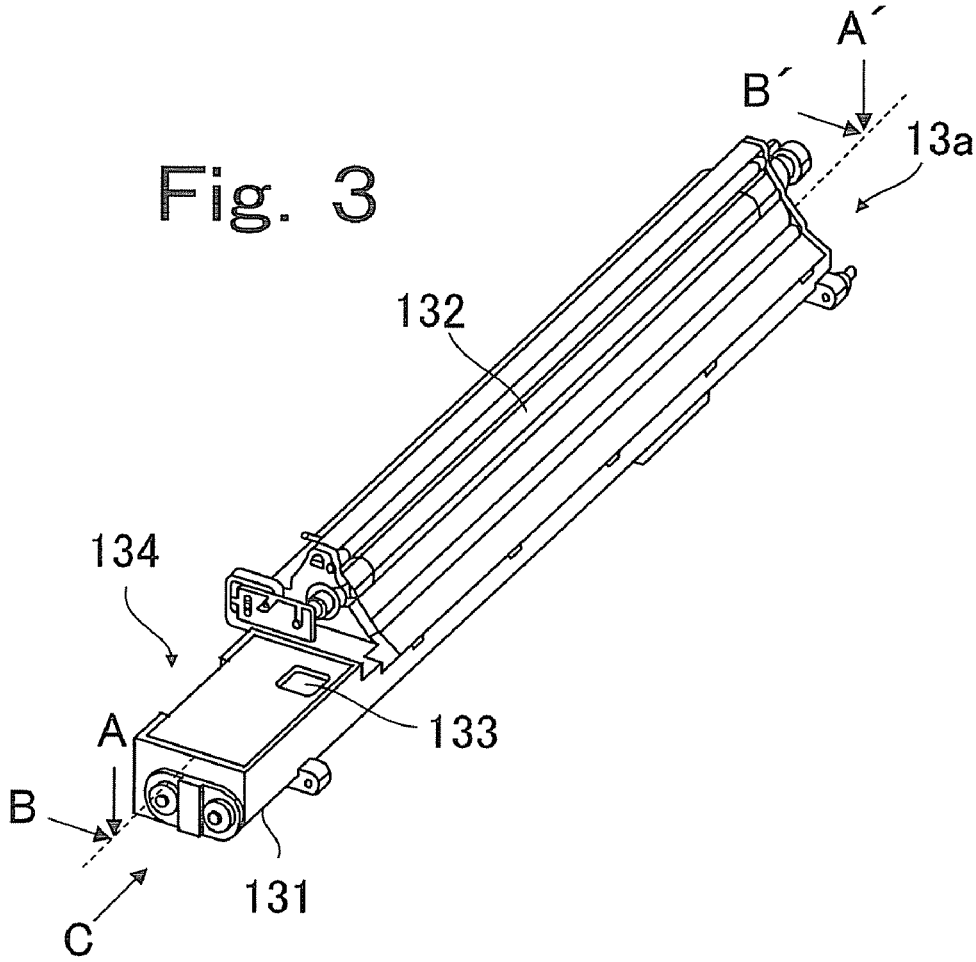
FIG. 3 is a perspective view of one developing device incorporated in the image forming apparatus shown in FIG. 2.
Figure 4:
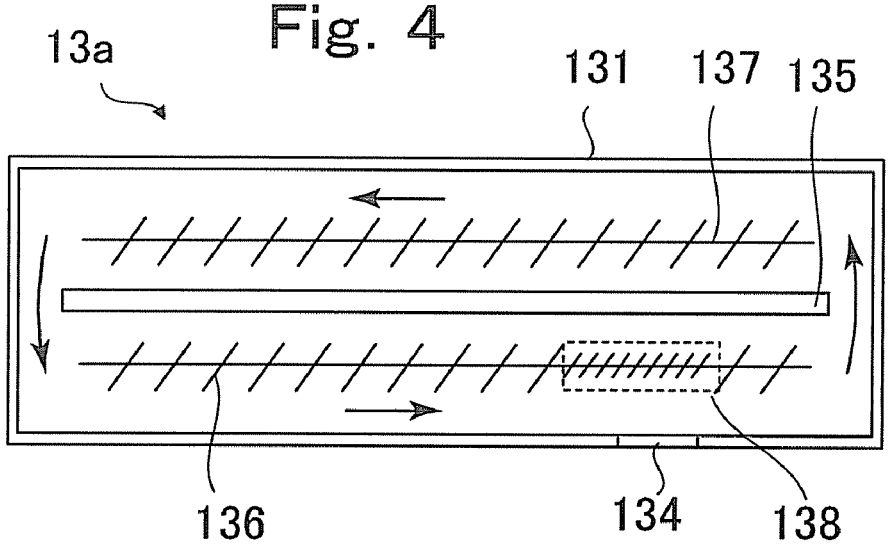
FIG. 4 is a top sectional view of the structure of the developing device shown in FIG. 3.

The structure of the developing device 13*a* according to this embodiment is specifically explained. FIG. 3 is a perspective view of the developing device 13*a*. FIG. 4 is a top sectional view taken along A-A' along a longitudinal direction of the developing device 13*a* shown in FIG. 3. In FIG. 4, a developer discharge port 134 is shown on a lower side.

Figure 5:
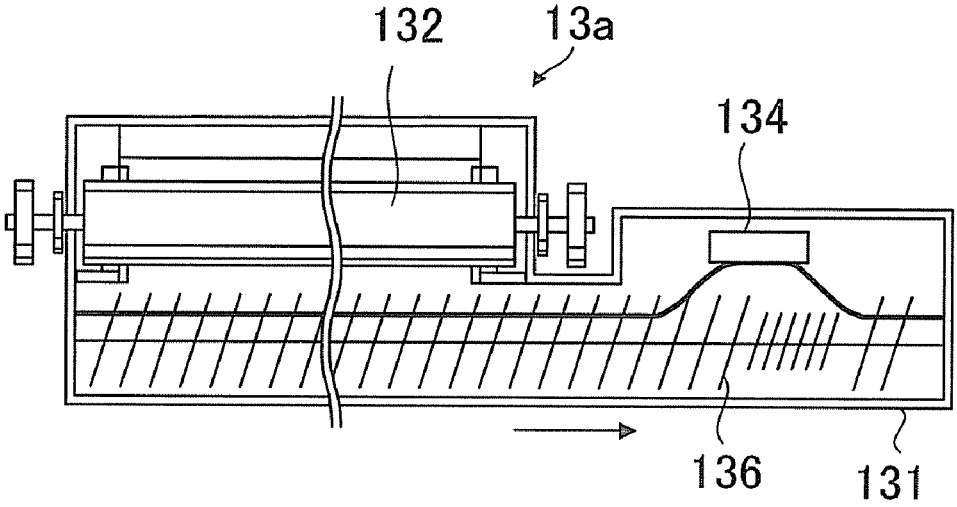
FIG. 5 is a side sectional view taken along a longitudinal direction of the developing device.
Figure 6:
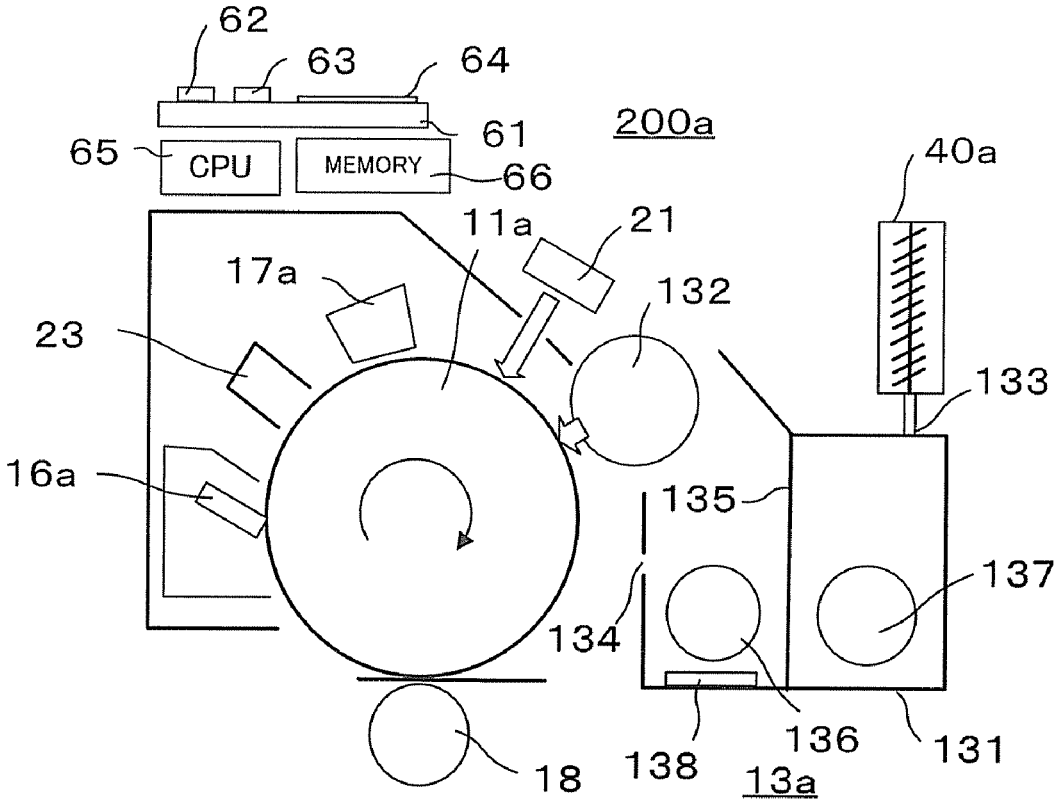
FIG. 6 is a diagram of the structure of an image forming apparatus including a developing device according to a first embodiment.

FIG. 5 is a side sectional view taken along B-B' along the longitudinal direction of the developing device 13*a* shown in FIG. 3. FIG. 6 is a diagram of the sectional structure of the developing device 13*a* viewed from an arrow C direction in FIG. 3.

As shown in FIG. 3, the developing device 13*a* includes a developer tank 131, the developing roller 132, a supply port 133, and the developer discharge port 134. The developer tank 131 stores a developer. The developing roller 132 is rotatably provided. The developing roller 132 is arranged to be opposed to the photoconductive drum 11*a*. The developing roller 132 itself rotates to thereby supply a toner and a carrier stored in the developer tank 131.

The supply port 133 is provided on the upper surface of the developer tank 131. The toner is supplied from a developer supply container 40*a* to the developer tank 131. The developer discharge port 134 is provided on the side of the developer tank 131. The developer discharge port 134 is formed in, for example, a rectangular shape and has a long side in a direction parallel to the longitudinal direction of the developer tank 131 and a short side in a height direction orthogonal to the longitudinal direction of the developer tank 131. The developer stored in the developer tank 131 overflows to be discharged from the developer discharge port 134.

As shown in FIG. 4, the developer tank 131 includes a partition plate 135, a first mixer 136, a second mixer 137, and a toner density detecting device 138. The developer tank 131 is divided into two spaces by the partition plate 135 along the longitudinal direction. The two spaces communicate with each other at both ends in the longitudinal direction of the developer tank 131.

The first mixer 136 and the second mixer 137 have spiral screws along the longitudinal direction of the developer tank 131. The first mixer 136 and the second mixer 137 rotate the screws to agitate and carry the developer in the developer tank 131. The first mixer 136 carries the developer along the longitudinal direction of the developer tank 131 in a direction opposite to a conveying direction of the developer by the second mixer 137. Therefore, the developer circulates in an arrow direction in the two spaces in the developer tank 131. During printing by the image forming apparatus 101, the developing roller 132, the first mixer 136, and the second mixer 137 rotate at the number of revolutions during normal printing set in advance. In this way, the developer tank 131 and the first mixer 136 and the second mixer 137 incorporated in the developer tank 131 configure an agitating and carrying unit configured to agitate and carry the developer.

The supply port 133 shown in FIG. 3 is provided in a position opposed to the second mixer 137 in the developer tank 131. In other words, the developer is supplied to a space of the developer tank 131 in which the second mixer 137 is provided. The developing roller 132 shown in FIG. 3 is provided in a position opposed to the first mixer 136 in the developer tank 131. A space of the developer tank 131 in which the first mixer 136 is provided is a developer carrying path on the developing roller 132 side. The toner density detecting device 138 is provided in the space of the developer tank 131 in which the first mixer 136 is provided. The toner density detecting device 138 detects toner density of the developer carried by the first mixer 136.

As shown in FIG. 5, the developing roller 132 is provided from one end to around the center along the longitudinal direction of the developer tank 131. The developer discharge port 134 is provided on the other end side of the developer tank 131 on which the developing roller 132 is not provided. The developing roller 132 is provided on an upstream side and the discharge port 134 is provided on a downstream side with respect to a direction in which the developer flows. In the developer tank 131, the height in the height direction of the developing roller 132 and the discharge port 134 is set smaller than the height of the other positions. In the first mixer 136, as shown in FIG. 5, a diameter of the screws near the discharge port 134 is set small and a pitch of the screws is set narrow.

The speed of the developer in the developer tank 131 falls near the developer discharge port 134 because of the shapes of the developer tank 131 and the screws of the first mixer 136. Therefore, when the developer flows in an arrow direction shown in FIG. 5, a surface of the developer (indicated by a bold solid line in FIG. 5) flowing in the developer tank 131 swells in a mountain shape on the side of the developer tank 131 on which the developer discharge port 134 is provided.

The developer discharge port 134 is provided, on the basis of the shapes of the developer tank 131 and the first mixer 136 and the rotating speed of the developing roller 132, the first mixer 136, and the second mixer 137, such that a top portion of the mountain of the developer surface coincides with a lower end in the center of the developer discharge port 134 in a state in which a reference amount of the developer is stored in the developer tank 131. Therefore, the developer surface does not flap at the lower end in the center of the developer discharge port 134.

When the developer is supplied anew from the developer supply container 40*a* to the developing device 13*a*, the developer in the developer tank 131 overflows from the developer discharge port 134 by an amount of the supplied developer and is stably discharged to the outside of the developer tank 131.

First Embodiment

The section of the structure of an image forming apparatus including the developing device 13*a* according to a first embodiment is shown in FIG. 6 in a simplified form. As explained later, in this embodiment, a toner without silica is used as a supply toner supplied from the developer supply container 40*a*.

In FIG. 6, a process unit 200*a* includes the cleaner 16*a*, the charge removing device 23, the charging device 17*a*, the laser unit 21, the developing roller 132, and the transfer device 18 around the photoconductive drum 11*a*. The photoconductive drum 11*a* rotates in a clockwise direction as indicated by an arrow.

A two-component developer including a toner and a carrier is supplied to the developing roller 132 from the developing device 13*a*. After being transferred onto a sheet by the transfer device 18, the developer is fixed on the sheet by the fixing device 19. The sheet is discharged to the outside. In the developing device 13*a*, the first mixer 136 and the second mixer 137 are disposed in two agitation passages formed via the partition plate 135 in the developer tank 131.

The developer is supplied to the second mixer 137 by the developer supply container 40*a*. The toner and the carrier are agitated by the second mixer 137 and moves in the direction of the first mixer 136.

The developer is supplied to the developing roller 132. The developing roller 132 includes a developing sleeve on the outer side and a magnet fixed in the inside. The developing roller 132 holds the developer in a laminated shape with magnetic force and applies developing bias to the developer, whereby development is performed on the photoconductive drum 11*a*.

The developer swells as shown in FIG. 5 because the diameter of the screw shape near the developer discharge port 134 is set small and the pitch of the screws is set narrow. The developer swells because a function for circulating and agitating the developer is reduced in this portion and the speed of the developer falls. A part of the swelled developer is discharged from the developer discharge port 134 provided on the side of the agitation passage in which the first mixer 136 is provided.

The toner density detecting device 138 for detecting toner density is provided at a bottom on the side of the developer tank 131 on which the first mixer 136 is provided. When it is detected on the basis of an output of the toner density detecting device 138 that the toner density in the developing device 13*a* falls and the developer decreases, the developer is supplied from the developer supply container 40*a*. The developer includes the carrier and the supply toner.

The developer is supplied to the developing device 13*a* from the developer supply container 40*a* via the supply port 133 when the toner density detecting device 138 detects that the toner density of the developing device 13*a* is lower than a predetermined value. When the developing device 13*a* develops an electrostatic latent image formed on the photoconductive drum 11*a* with the toner, the toner density in the developing device 13*a* falls. The toner density detecting device 138 detects whether the toner density in the developing device 13*a* is lower than the predetermined value.

The carrier is also supplied to the developing device 13*a* from the developer supply container 40*a* simultaneously with the toner. The developer in the developer tank 131 overflows to be discharged from the developer discharge port 134 by an amount of the supplied developer. Therefore, an amount of the developer in the developer tank 131 is maintained constant. Further, in the developer tank 131, the old deteriorated carrier is discharged from the developer discharge port 134 and replaced with the new carrier little by little.

A control panel 61 includes a print button 62 for instructing copying (printing), a number-of-printed-sheets button 63 for instructing, with a number, the number of sheets to be printed, and a display unit 64 configured to indicate a state of a copying apparatus (the image forming apparatus 101). The image forming apparatus 101 also includes a CPU 65 configured to manage control of the entire image forming apparatus 101 and a memory 66 configured to store data necessary for the control.

The developer used in this embodiment is explained. As the developer in this embodiment, a two-component developer including a toner and a magnetic carrier is used. As the toner, a toner including binding resin and a colorant as main components is used. As the binding resin, polystyrene, styrene acryl copolymer, polyester, epoxy resin, silicon resin, polyamide, paraffin wax, or the like can be used. As the colorant, pigment and dye are used. Carbon black, aniline blue, pigment red, pigment yellow, or the like is used. A charging control agent, a cleaning support agent, a releasability accelerator, a fluidity accelerator, or the like can be contained according to necessity.

As the carrier, magnetic particles of ferrite, iron oxide, or the like can be used or a carrier obtained by coating the magnetic particles as a core material with resin can be used. As the resin for coating the carrier, fluoric resin, acrylic resin, silicon resin, or the like can be used. The single resin or a combination of plural kinds of the resins can also be used. Besides, for example, the resin containing magnetic powder can also be used.

The developer supplied by the developer supply container 40*a* is explained. The two-component developer obtained by mixing the toner and the carrier is produced by a mixing device. As the mixing device, a Henschel mixer or the like is used. The most part of the supply developer is a toner and a small amount of carrier is mixed with the toner.

As explained above, the developer to be supplied includes the toner and the carrier. The toner is consumed according to image formation. However, the carrier remains in the developer tank 131 of the developing device 13*a*. Therefore, when it is attempted to keep the toner density of the developer in the developer tank 131 constant, an amount of the developer in the developer tank 131 increases according to the supply of the developer. Therefore, the excess developer in the developer tank 131 overflows from the developer discharge port 134 for developer discharge provided on the wall surface of the developer tank 131 and is discharged to the outside of the developer tank 131.

The supply and the discharge of the developer are sequentially repeated in this way, whereby the old developer in the developer tank 131 is replaced with the developer supplied anew. In the developer tank 131, a characteristic of the developer is satisfactorily maintained by such supply and discharge of the developer and an amount of the developer is kept constant. Problems of the developing system in the past and causes of the problems Problems of the developing device in the past are explained below. It was found that, when a normal toner same as the toner supplied first was supplied as the toner of the two-component developer, the fluidity of the developer was deteriorated as the number of developed sheets increased.

When the fluidity of the developer is deteriorated, the developer is less easily discharged from the discharge port. The developer is held up in the developing device more than necessary and is not discharged unless the developer increases to a relatively large amount. Therefore, when a large amount of the developer remains in the developing device, pressure is applied to the developer. The developer spills, agitation performance for the carrier falls, and density unevenness is caused. As a result, high image quality cannot be maintained.

The inventors checked a cause of such deterioration in the fluidity of the developer through an experiment and an investigation. As a result, it was found that one cause of the deterioration was silica.

Figure 7:
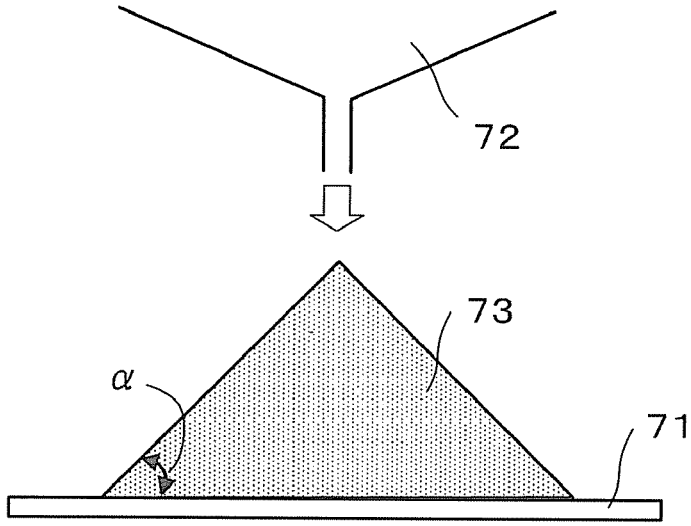
FIG. 7 is a diagram for explaining an angle of repose.

First, the inventors checked angles of repose by increasing the number of copies in the case of the toner in the past containing silica as an externally added agent and the toner in an embodiment of the present invention not containing silica. A state of measurement of the angles of repose is briefly shown in FIG. 7. A funnel 72 was provided above a substrate 71. A two-component developer including a powder toner and a carrier was dropped to the funnel 72. An angle of inclination $\alpha$ formed by a mountain of a deposit 73 formed on the substrate 71 with respect to the substrate 71 was measured. The angle of inclination $\alpha$ is an angle of repose.

In the standard R9301-2-2, the angle of repose is defined as being obtained by dropping an alumina powder sample from a predetermined funnel made of stainless steel at fixed height onto a substrate of a flat shape and structure and calculating a bottom angle from the diameter and the height of a generated conical deposit.

In the experiment performed by the inventors, the two-component developer including the toner and the carrier was used instead of the alumina powder sample. As the developer, the toner containing silica as the externally added agent is used besides the carrier as in the past and the supply toner not containing silica as the externally added agent is used besides the carrier as in the embodiment.

Figures 8A, 8B:
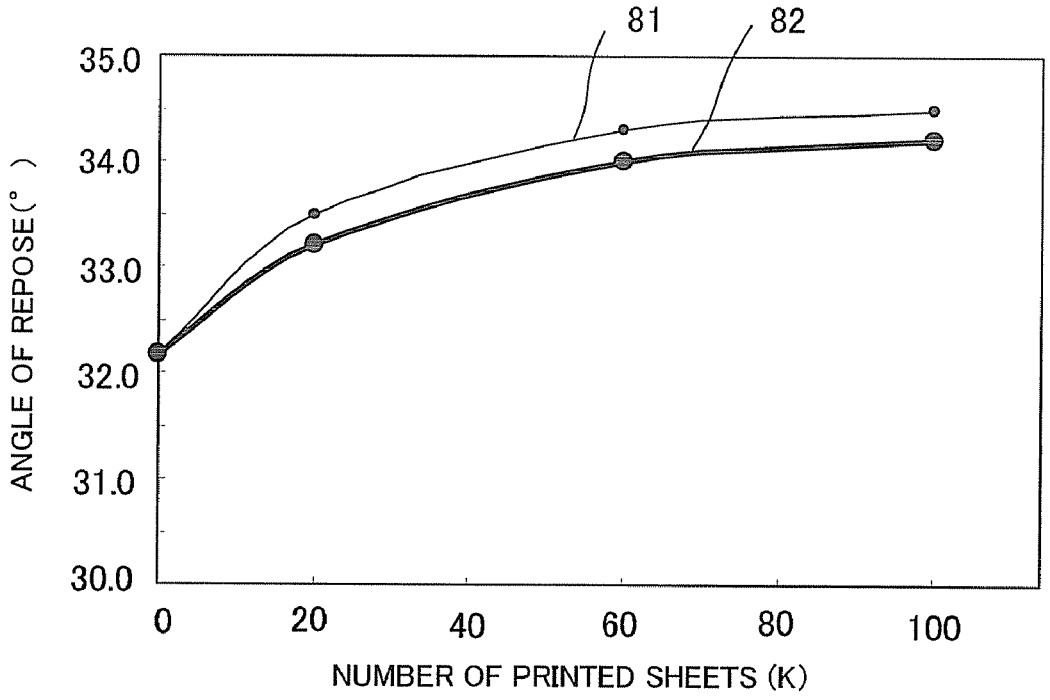
FIG. 8A is a table of data obtained by comparing angles of repose of a toner used in the first embodiment and a toner in the past.
FIG. 8B is a graph of the comparison of the angles of repose shown in FIG. 8A.

The inventors performed a life test while storing such a developer in the developer supply container 40*a* and supplying the developer and investigated the fluidity of the developer by increasing the number of times of printing. FIGS. 8A and 8B are a table and a graph of a result obtained by performing the test at a printing ratio of 5%.

An angle of repose of the developer was measured when the number of printed sheets was 0 (before printing), 20K, 60K, and 100K. Data of a change in the angle of repose as a result of the measurement is shown in FIG. 8A. As an apparatus for the measurement, a powder and granule characteristic apparatus manufactured by Tsutsui Scientific Instruments Co., Ltd. was used.

A graph based on the data of the change in the angle of repose shown in FIG. 8A is shown in FIG. 8B. In FIG. 8B, the abscissa indicates the number of printed sheets and the ordinate indicates the angle of repose (degree). In FIG. 8B, a data curve 81 indicates a change in the angle of repose that occurred when the two-component developer including toner containing silica as the externally added agent in the past was supplied. A data curve 82 indicates a change in the angle of repose that occurred when the two-component developer including the toner without silica in the first embodiment was supplied. When the number of printed sheets was 0, the angle of repose was 32.2 degrees.

When the developer in the past including the toner containing silica was supplied, the angle of repose changed to 33.5 degrees, 34.4 degrees, and 34.6 degrees when the number of printed sheets was 20K, 60K, and 100K. On the other hand, when the developer in the first embodiment including the toner not containing silica was supplied, the angle of repose changed to 33.2 degrees, 34.0 degrees, and 34.2 degrees. In this way, it was found that, irrespectively of the number of printed sheets, the angle of repose was smaller and the fluidity of the toner was higher in the case of the developer in the embodiment than in the case of the developer in the past.

Figure 9:
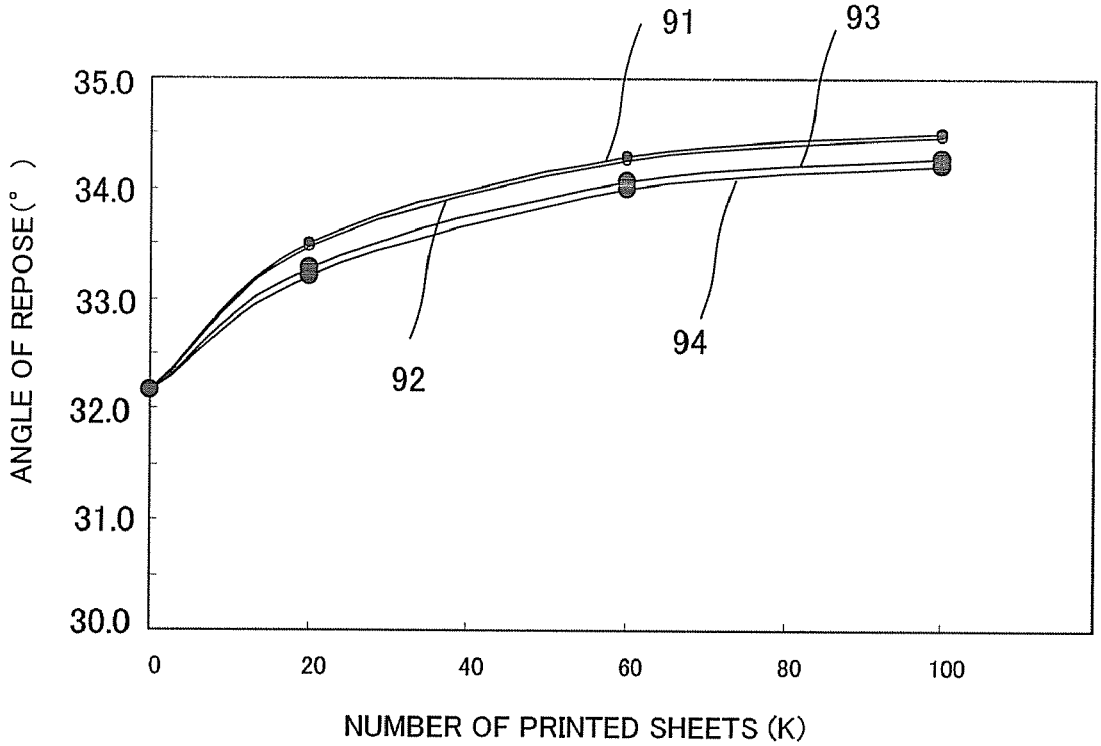
FIG. 9 is a graph of changes in an angle of repose with respect to the number of printed sheets that occur when an amount of silica contained in a toner is changed.

A change in the angle of repose that occurred when a percentage of silica contained in a toner was changed is shown in FIG. 9. A life test was performed while storing a developer mixed with a toner externally added with a very small amount of silica in a developer supply container and the fluidity of the developer was investigated. The test was performed at a printing ratio of 5%. A data curve 91 indicates a change in the angle of repose that occurred when the developer including the toner containing silica in the past was supplied. Data curves 92, 93, 94, and 95 indicate changes in the angle of repose that occurred when a percentage of silica contained in the toner was 1%, 0.5%, and 0% per toner weight ratio.

It is understood from the figure that the angle of repose is almost the same as that in the past when an amount of silica is about 1% but the angle of repose decreases when the amount of silica is reduced to be equal to or smaller than about 0.5 wt %.

Figures 10A, 10B:
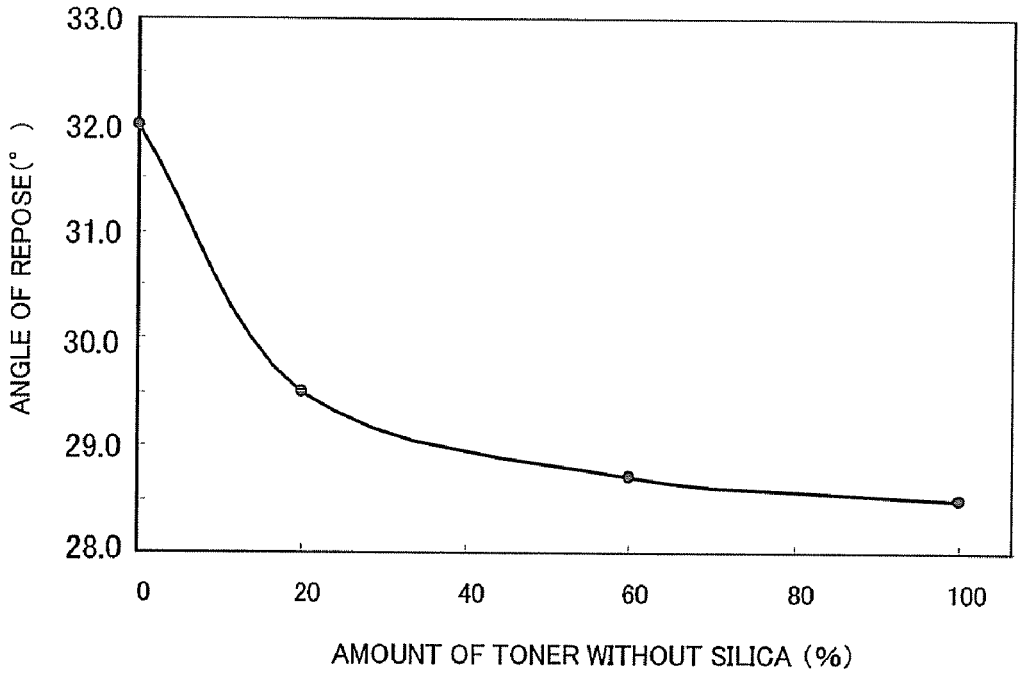
FIG. 10A is a table of data indicating a change in an angle of repose that occurs when a ratio of a toner without silica is changed.
FIG. 10B is a graph based on the data shown in FIG. 10A.

A life test was performed while storing a developer mixed with a toner externally added with a very small amount of silica on the surface in a developer supply container and the fluidity of the developer was investigated. FIGS. 10A and 10B are a table and a graph of a result obtained by performing the test at a printing ratio of 5%.

When a percentage of silica contained in the toner was larger than 0.5 wt %, the fluidity was substantially the same as that in the past and no effect of improvement of the fluidity was observed. It was found that, at 0.5 wt %, the angle of repose was slightly larger than that in the case of the toner containing no silica but the fluidity was improved. The life of the developer means practical life that is a limit for obtaining a satisfactory image.

When the percentage of silica contained in the toner was 0.5 wt %, an image output during the life test for 100K sheets had no density unevenness and was a satisfactory image. The weight of the developer after the life test was about 440 g and a rate of increase was about +10%. After the life test, a roof portion of the developing device was removed and a state of the developer was checked. Only a screw portion of the mixer was exposed and seen and no problem was found. Eventually, it was confirmed that an effect was obtained in the developer mixed with the toner externally added with silica on the surface at a percentage equal to or lower than about 0.5%.

In FIG. 10A, an investigation result is shown that was obtained by comparing angles of repose of a developer including a toner with silica to which silica was externally added and a developer obtained by adding a toner without silica to the toner with silica to which silica was externally added.

As shown in FIG. 10A, when an amount of the toner without silica was 0%, 20%, 60%, and 100%, the angle of repose was respectively 32.0 degrees, 29.5 degrees, 28.8 degrees, and 28.5 degrees. A graph of a change in the angle of repose is shown in FIG. 10B. The amount (%) of the toner without silica is plotted on the abscissa and the angle of repose (degree) is plotted on the ordinate.

It is seen that the angle of repose is smaller and the fluidity is higher as the added amount of toner without silica is larger.

Density unevenness and a spill of the developer at the time when the number of printed sheet was 20K, 60K, and 100K in the first embodiment were compared with those in the past. As result of the comparison is shown in FIG. 11.

When the toner with silica in the past was supplied, the density unevenness and the spill of the developer started to be less satisfactory when the number of printed sheets was 60K. When the number of printed sheets increased to about 100K, the density unevenness and the spill of the developer were completely dissatisfactory.

On the other hand, in the first embodiment, even if the number of printed sheets was increased to about 100K, the density unevenness and the spill of the developer hardly occurred. The weight of the developer after the life test was about 430 g and a rate of increase was about +8%. When a roof portion of the developing device was removed and a state of the developer was checked, only a blade portion of the mixer was exposed and seen and no problem was found.

In the case of the toner in the past, the density unevenness and the spill of the developer due to a density fall occurred during the life test. The weight of the developer after the life test was about 480 g and a rate of increase reached +20%. When the roof portion of the developing device was removed, an amount of the developer was extremely large and agitation was not considered to be satisfactorily performed.

It is understood that, in this embodiment, deterioration in the fluidity is suppressed by reducing floating silica. Therefore, a printed image has no density unevenness and no spill of the developer from the developing device occurred.

Second Embodiment

Figure 12:
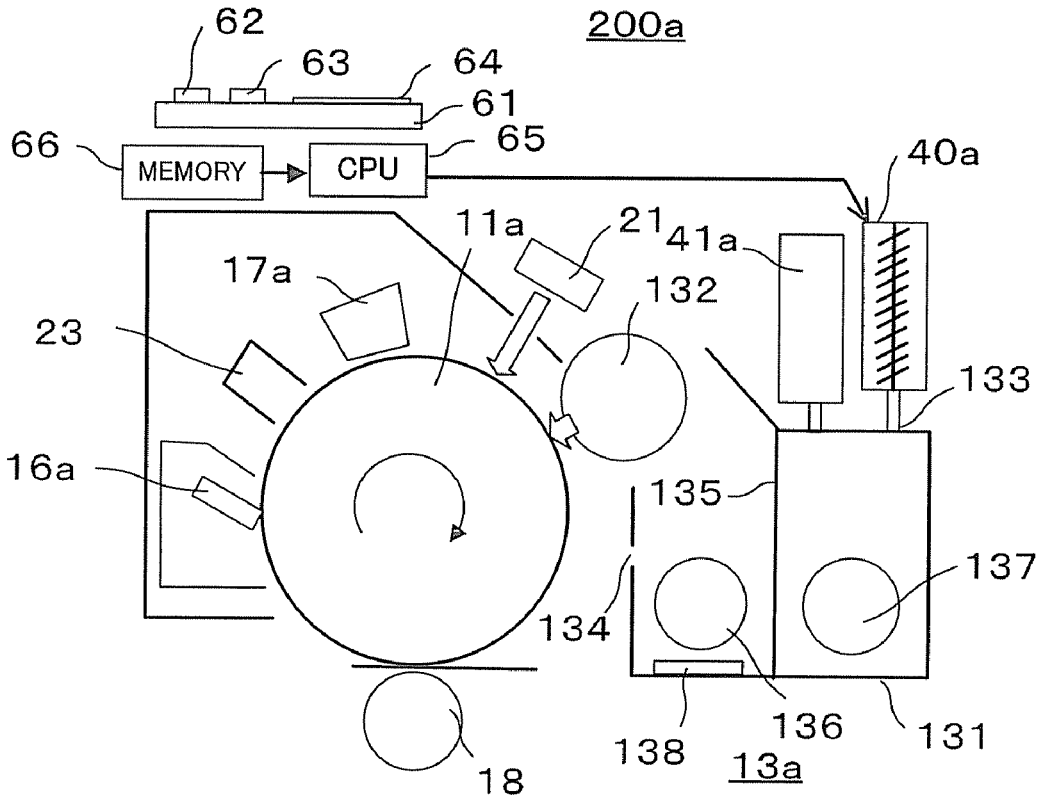
FIG. 12 is a diagram of the structure of an image forming apparatus including a developing device according to a second embodiment.

The configuration of an image forming apparatus according to a second embodiment is shown in FIG. 12. The configuration is different from that in the first embodiment in that a toner hopper 41*a* is provided and supply of a developer is performed in comparison with data stored in the memory 66. Other components are the same as those in the first embodiment.

In the first embodiment, the developer including the carrier and the toner without silica (the supply toner) is supplied from the developer supply container 40*a* shown in FIG. 6. On the other hand, in the second embodiment explained below, a toner itself is supplied from the toner hopper 41*a*. The toner supplied by the toner hopper 41*a* is the toner in the past (the initial toner) containing silica as the externally added agent.

In FIG. 12, since the other components are the same as those shown in FIG. 6, the components are denoted by the same reference numerals and signs. In FIG. 12, the process unit 200*a* includes the cleaner 16*a*, the charge removing device 23, the charging device 17*a*, the laser unit 21, the developing roller 132, and the transfer device 18 around the photoconductive drum 11*a*. The photoconductive drum 11*a* rotates in a clockwise direction indicated by an arrow.

The two-component developer including the toner and the carrier is supplied to the developing roller 132 from the developing device 13*a*. After the developer is transferred onto a sheet by the transfer device 18, the developer is fixed on the sheet by the fixing device 19. The sheet is discharged to the outside. In the developing device 13*a*, the first mixer 136 and the second mixer 137 are disposed in two agitation passages formed via the partition plate 135 in the developer tank 131.

The developer is supplied to the second mixer 137 by the developer supply container 40*a*. The toner and the carrier are agitated by the second mixer 137 and move in the direction of the first mixer 136.

The developer is supplied to the developing roller 132. The developing roller 132 includes a developing sleeve on the outer side and a magnet fixed in the inside. The developing roller 132 holds the developer in a laminated shape with magnetic force and applies developing bias to the developer, whereby development is performed on the photoconductive drum 11*a*.

In the second embodiment, print data indicating how many images with how high quality are printed is stored in the memory 66. When it is determined according to the print data that the developer reaches a limit (a practical life) for obtaining a satisfactory image, the developer is supplied from the developer supply container 40*a*.

Figures 13A, 13B:
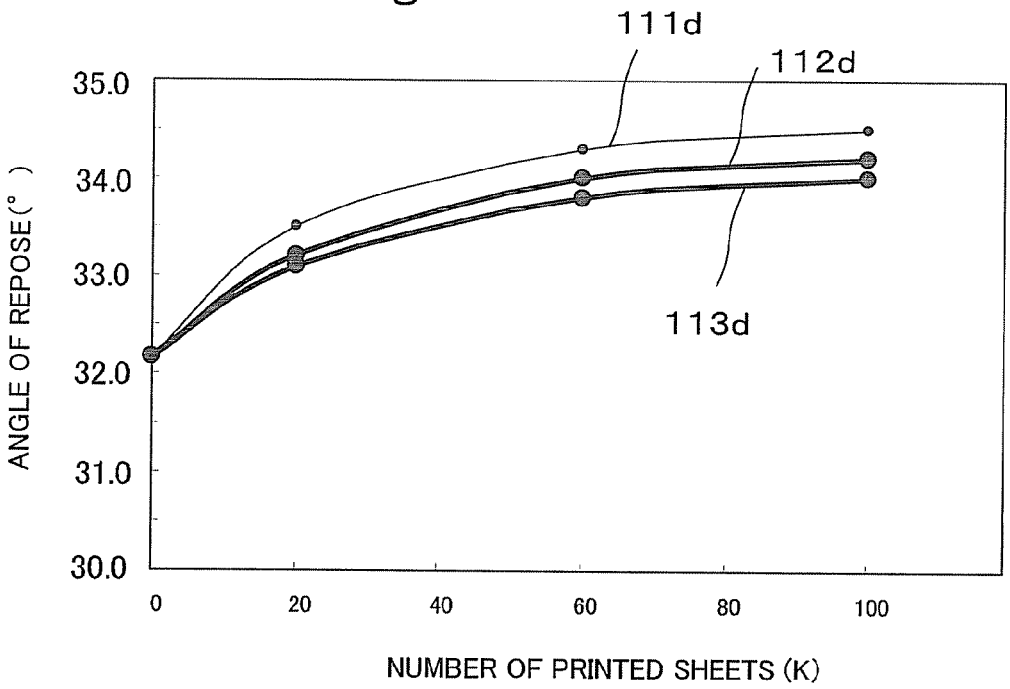
FIG. 13A is a table of data of a change in an angle of repose that occurs when the number of printed sheets is increased in the second embodiment, wherein the data is compared with those in the first embodiment and in the past.
FIG. 13B is a graph of an angle of repose based on the data shown in FIG. 13A.

Data of a change in an angle of repose with respect to the number of printed sheets in the second embodiment is shown in FIG. 13A. In the first embodiment, besides the carrier, the toner without silica is supplied from the developer supply container 40*a* as the toner. In the second embodiment, an amount of the toner consumed by development is supplied into the developing device 13*a* from the toner hopper 41*a*. The developer is supplied according to a recording state. When it is determined that the developer reaches the life (the practical life), the developer is supplied. The developer supplied when it is determined that the developer reaches the life is the two-component developer including the toner without silica and the carrier.

A printing ratio was set to 5%. In the second embodiment, when the number of printed sheets was 20K, 60K, and 100K, the angle of repose was respectively 33.1 degrees, 33.6 degrees, and 34.0 degrees.

The change in the angle of repose is shown in FIG. 13B. In FIG. 13B, the number of printed sheets is plotted on the abscissa and the angle of repose (degree) is plotted on the ordinate. In FIG. 13B, a data curve 111*d* indicates a change that occurs when the toner with silica is supplied together with the carrier as in the past. A data curve 112*d* indicates a change that occurs when the toner without silica is supplied together with the carrier as in the first embodiment. A data curve 113*d* indicates a change that occurs when an amount of the toner consumed by development is supplied into the developing device 13*a* from the toner hopper 41*a* and the developer is supplied according to a recording state and, when it is determined that the developer reaches the life, the developer is supplied.

It is understood from FIGS. 13A and 13B, compared with the first embodiment, according to the second embodiment, an increase in the angle of repose is suppressed, the fluidity is high, and the fluidity of the toner can be maintained.

While certain embodiments have been described, these embodiments have been presented by way of example only, and are not intended to limit the scope of the inventions. Indeed, the novel systems described herein may be embodied in a variety of other forms: furthermore, various omissions, substitutions and changes in the form of the systems described herein may be made without departing from the spirit of the inventions. The accompanying claims and their equivalents are intended to cover such forms or modifications as would fall within the scope and spirit of the inventions.

What is claimed is:

1. A developing device, comprising:

a developing unit configured to store an initial two-component developer including an initial toner containing silica externally added and a carrier and to form a toner image on an image bearing member with the two-component developer;

a discharging section configured to discharge a part of the initial developer from the developing unit; and a developer supplying unit configured to supply a supply developer including a supply toner containing silica externally added and the carrier to the developing unit, the amount of silica added to the supply toner being smaller than the amount of silica added to the initial toner.

2. The device according to claim 1, wherein the supply toner contains an amount of silica equal to or smaller tan 0.5 wt % with respect to the supply toner.

3. The device according to claim 2, further comprising a toner supplying unit configured to supply the initial toner to the developing unit.

4. The device according to claim 3, wherein the supply of the two-component developer by the developer supplying unit is performed when the developer reaches a practical life when printing by development of a number of sheets set in advance ends.

5. The device according to claim 4, wherein the initial toner contains an amount of silica in a range of about 3 wt % to about 5 wt % with respect to the initial toner.

6. A developing device for an image forming apparatus comprising:

a developing unit configured to store an initial two-component developer including an initial toner containing silica externally added and a carrier, agitate and carry the two-component developer with a mixer, blades of a screw shape of which rotate, and form a toner image on an image bearing member with the two-component developer;

a discharging section having, in a part of the mixer of the developing unit, a discharge port for discharging a part of the initial developer to an outside in a region where a diameter of the blades or an interval of the blades is smaller than that in a region other than the part of the mixer; and a developer supplying unit configured to supply a supply developer including a supply toner containing an amount of silica smaller than that of the initial toner and the carrier to the developing unit.

7. The device according to claim 6, wherein the supply toner included in the developer supplied from the developer supply unit to the developing unit contains an amount of silica equal to or smaller tan 0.5 wt % with respect to the supply toner.

8. The device according to claim 7, further comprising a toner supplying unit configured to supply the initial toner to the developing unit.

9. The device according to claim 8, wherein the supply of the two-component developer by the developer supplying unit is performed when the developer reaches a practical life when printing by development of a number of sheets set in advance ends.

10. The device according to claim 9, wherein the initial toner contains an amount of silica in a range of about 3 wt % to about 5 wt % with respect to the initial toner.

11. A developing device, comprising:

a developing unit including a developer tank in which an initial two-component developer including an initial toner containing silica externally added and a carrier is stored, a partition plate configured to divide the developer tank into two regions excluding ends thereof, two mixers provided in the two regions divided by the partition plate such that blades of a screw shape rotate, the developing unit agitating and carrying the initial two-component developer according to the rotation of the blades of the two mixers and forming a toner image on an image bearing member with the two-component developer;

a discharging section having, in a part of the mixer of the developing unit, a discharge port for discharging a part of the initial developer to an outside in a region where a diameter of the blades or an interval of the blades is smaller than that in a region other than the part of the mixer; and a developer supplying unit configured to supply a supply developer including a supply toner containing silica externally added and the carrier to the developing unit, the amount of silica added to the supply toner being smaller than the amount of silica added to the initial toner.

12. The device according to claim 11, wherein the supply toner included in the developer supplied from the developer supply unit to the developing unit contains an amount of silica equal to or smaller than 0.5 wt % with respect to the supply toner.

13. The device according to claim 12, further comprising a toner supplying unit configured to supply the initial toner to the developing unit.

14. The device according to claim 13, wherein the supply of the two-component developer by the developer supplying unit is performed when the developer reaches a practical life when printing by development of a number of sheets set in advance ends.

15. The device according to claim 14, wherein the initial toner contains an amount of silica in a range of about 3 wt % to about 5 wt % with respect to the initial toner.

16. A developing method for an image forming apparatus, comprising:

forming a toner image on an image bearing member with a two component initial developer including an initial toner containing silica externally added and a carrier stored in a developing unit;

discharging a part of the initial developer from the developing unit; and supplying a supply developer including a supply toner containing an amount of silica smaller than that of the initial toner and the carrier to the developing unit.

17. The method according to claim 16, wherein the supply toner included in the developer supplied to the developing unit contains an amount of silica equal to or smaller tan 0.5 wt % with respect to the supply toner.

18. The method according to claim 17, further comprising supplying the initial toner to the developing unit.

19. The method according to claim 18, wherein the supply of the two-component developer is performed when the developer reaches a practical life when printing by development of a number of sheets set in advance ends.

20. The method according to claim 19, wherein the initial toner contains an amount of silica in a range of about 3 wt % to about 5 wt % with respect to the initial toner.

* * * * *